US011732989B2

(12) United States Patent
Kras et al.

(10) Patent No.: US 11,732,989 B2
(45) Date of Patent: Aug. 22, 2023

(54) MOUNTING AND RETENTION ASSEMBLY FOR SUPPRESSORS

(71) Applicant: Sig Sauer, Inc., Newington, NH (US)

(72) Inventors: Krzysztof J. Kras, Fremont, NH (US); Lindsay Lee Bunch, Deerfield, NH (US)

(73) Assignee: Sig Sauer, Inc., Newington, NH (US)

( * ) Notice: Subject to any disclaimer, the term of this patent is extended or adjusted under 35 U.S.C. 154(b) by 168 days.

(21) Appl. No.: 17/314,132

(22) Filed: May 7, 2021

(65) Prior Publication Data

US 2021/0356225 A1 Nov. 18, 2021

Related U.S. Application Data

(60) Provisional application No. 63/024,054, filed on May 13, 2020.

(51) Int. Cl.
*F41A 21/32* (2006.01)
*F41A 21/30* (2006.01)

(52) U.S. Cl.
CPC ..... *F41A 21/325* (2013.01); *F41A 21/30* (2013.01)

(58) Field of Classification Search
CPC ..... F41A 21/30–38
USPC ..... 89/14.2–14.4; 181/223
See application file for complete search history.

(56) References Cited

U.S. PATENT DOCUMENTS

| | | | | |
|---|---|---|---|---|
| 8,186,261 | B2 * | 5/2012 | McNeill | F41A 21/38 42/1.06 |
| 8,464,625 | B2 * | 6/2013 | Polovnev | F41A 21/28 89/14.2 |
| 8,499,676 | B1 * | 8/2013 | Moore | F41A 21/325 89/14.4 |
| 9,513,078 | B1 * | 12/2016 | Fulton | F41A 21/325 |
| 9,709,354 | B2 * | 7/2017 | Larue | F41A 21/34 |
| 9,921,021 | B1 * | 3/2018 | Graham, II | F41A 21/325 |
| 9,958,227 | B2 * | 5/2018 | Whitson | F41A 21/325 |
| 10,082,355 | B2 * | 9/2018 | Addis | F41A 21/36 |
| 10,156,411 | B2 * | 12/2018 | Thompson | F41A 21/325 |
| 10,801,796 | B2 * | 10/2020 | Kras | F41A 21/325 |
| 11,156,423 | B2 * | 10/2021 | Winterseth | F41A 21/325 |
| 2010/0229712 | A1 * | 9/2010 | Graham | F41A 21/34 42/76.01 |
| 2018/0058791 | A1 * | 3/2018 | Larue | F41A 21/325 |

* cited by examiner

*Primary Examiner* — Joshua E Freeman
*Assistant Examiner* — Benjamin S Gomberg
(74) *Attorney, Agent, or Firm* — Finch & Maloney PLLC

(57) ABSTRACT

An assembly is configured for retaining a muzzle accessory mounted on a firearm barrel or to a muzzle adapter on the barrel, where the muzzle accessory has a mount with female threads on an inside and male threads on an outside of the mount. The outside of the muzzle adapter has male threads and a bearing surface. A locking nut has inner female threads and an inside taper located proximally of the female threads. A locking ring has a tapered outside face configured to engage the inside taper of the locking nut and an inside face configured to engage the bearing surface. When assembled, the mount is threaded onto the muzzle adapter and the locking nut is threaded onto the accessory mount with the locking ring engaging the bearing surface of the muzzle adapter and the inside taper of the locking nut.

20 Claims, 9 Drawing Sheets

MOUNTING AND RETENTION ASSEMBLY FOR SUPPRESSORS

RELATED APPLICATIONS

This application claims the benefit under 35 U.S.C. § 119(e) of U.S. Provisional Patent Application No. 63/024,054, titled MOUNTING AND RETENTION ASSEMBLY FOR SUPPRESSORS, and filed on May 13, 2020, the contents of which are incorporated herein by reference in its entirety.

FIELD OF THE DISCLOSURE

This disclosure relates to firearms and more particularly to a mounting assembly for firearm muzzle accessories, such as suppressors.

BACKGROUND

The design of firearm accessories involves many non-trivial challenges. Some accessories are designed to be mounted to the muzzle of a firearm barrel, such as a muzzle brake, suppressor, or other device. A muzzle brake or flash hider is typically mounted to the muzzle in a particular rotational orientation in order to prevent gases from being redirected upward into the line of sight of the firearm operator or directed into the ground where escaping gases can stir up dust. Suppressors are another muzzle accessory intended to reduce the audible and/or visible signature of the firearm by slowing the release of pressurized gases from the barrel. Among other challenges, muzzle accessories are designed to endure high temperatures and to maintain alignment with the bore axis to avoid a projectile striking the attachment.

SUMMARY

The present disclosure is directed to a mounting assembly and methodologies for mounting and retaining firearm muzzle accessories on the firearm barrel. One such muzzle accessory is a suppressor configured for use with a machine gun. Other muzzle accessories and host weapons can be used, as will be appreciated.

The features and advantages described herein are not all-inclusive and, in particular, many additional features and advantages will be apparent to one of ordinary skill in the art in view of the drawings, specification, and claims. Moreover, it should be noted that the language used in the specification has been selected principally for readability and instructional purposes and not to limit the scope of the disclosed subject matter.

Figure 1:
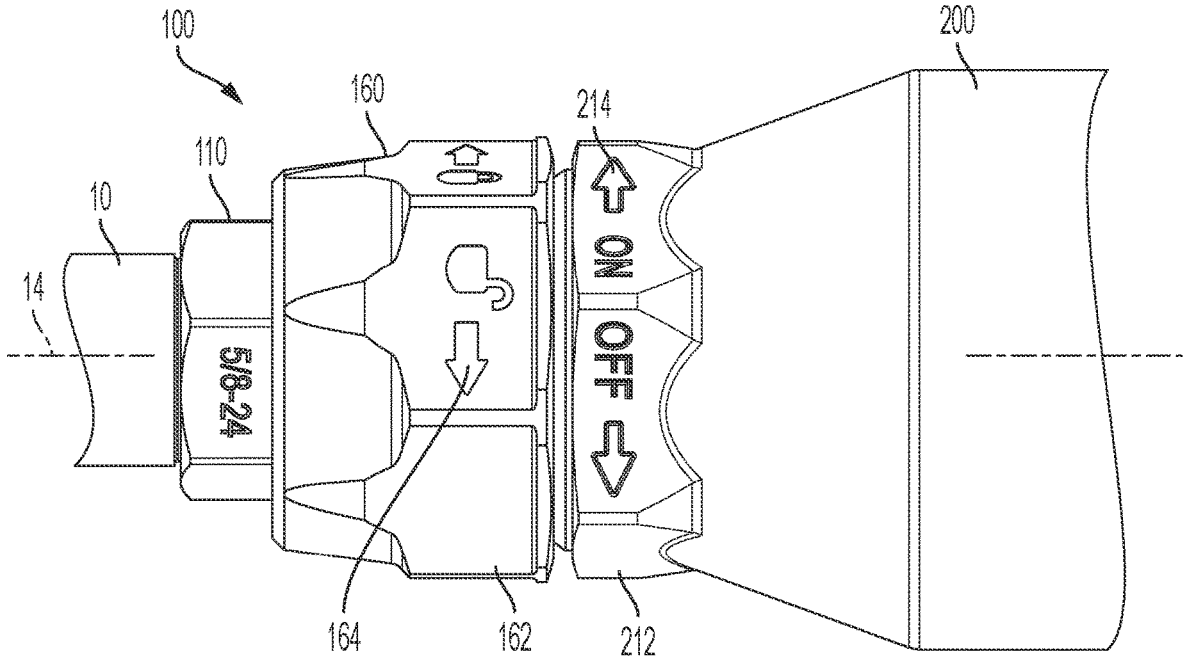
FIG. 1 illustrates a side view of a mounting assembly in use to retain a suppressor on a barrel of a firearm, in accordance with an embodiment of the present disclosure.

These and other features of the present embodiments will be better understood by reading the following detailed description, taken together with the Figures herein described. In the drawings, each identical or nearly identical component that is illustrated in various figures may be represented by a like numeral. For purposes of clarity, not every component may be labeled in every drawing. Furthermore, as will be appreciated, the figures are not necessarily drawn to scale or intended to limit the present disclosure to the specific configurations shown. In short, the Figures are provided merely to show example structures.

DETAILED DESCRIPTION

A mounting assembly and methodologies for mounting and retaining a muzzle accessory to a firearm barrel are disclosed. In accordance with some embodiments, a mounting assembly is configured for use with a suppressor or other muzzle accessory that includes an accessory mount having an inside surface defining female threads and an outside surface defining male threads. The mounting assembly includes a muzzle adapter configured for installation on a muzzle end of a firearm barrel, such as by threaded engagement, welding, or other attachment method. The muzzle adapter has an adapter body with an outside surface defining male threads and a bearing surface located proximally of the male threads. The male threads are sized and configured to engage the female threads of the accessory mount. In one example, the muzzle adapter provides a threaded surface of larger diameter than the barrel. In another example, the muzzle adapter is a flash hider that fits into the proximal end of a suppressor.

The mounting assembly also includes a locking nut and locking ring. The locking nut defines a central proximal opening at its proximal end and defines a central distal opening at its distal end. The locking nut has an inside surface with female threads sized and configured to engage the male threads on the outside of the accessory mount. The locking nut also has an inside taper located proximally of the female threads. The locking ring has an inside face configured to engage the bearing surface on the muzzle adapter and has an outside face that includes an outside taper configured to engage the inside taper of the locking nut. For example, the locking ring is a split ring generally having a hoop shape or band in which the ring's axial length is greater than the ring thickness. The inside taper and the outside tapers are configured so that the locking ring becomes bound between the inside taper of the locking nut and the bearing surface of the muzzle adapter.

A method of attaching and retaining a muzzle accessory on a firearm barrel is also disclosed. In accordance with one embodiment of the method, the muzzle adapter is installed on a muzzle end of the barrel. The mounting assembly is provided with the locking ring on the inside of the locking nut. In some embodiments, the mounting assembly is coupled to the accessory mount and in a loosened state with respect to the accessory mount. With the barrel and muzzle adapter extending through the locking nut, the accessory mount can be threaded onto the muzzle adapter and tightened. The locking nut can then be threaded onto the accessory mount. As the locking nut is tightened, the locking ring is positioned between and engages the bearing surfaces on the muzzle adapter and the inside taper of the locking nut. The locking ring binds between the locking nut and muzzle adapter to prevent loosening of the muzzle accessory's threaded engagement with the muzzle adapter during use of the firearm.

When used with a suppressor on a machine gun, for example, the locking ring and locking nut function as a secondary retention mechanism that positively retains the muzzle accessory on the barrel. The locking nut and locking ring provide relatively easy removal of the muzzle accessory after use of the suppressor and the associated thermal cycling and carbon deposits that accompany prolonged or heavy fire. This is unlike traditional attachment methods where the suppressor is tightened onto the barrel with greater torque to prevent it from coming loose, and where heat generated from firing the machine gun renders the suppressor nearly impossible to remove. In some embodiments, the locking ring can be unseated from the bearing surface of the muzzle adapter when the operator applies loosening torque to the locking nut, freeing the bound tapers and causing the retaining ring to expand in size. The force needed to unseat the locking ring is typically greater than forces of recoil, vibration, and the like that can otherwise loosen the threaded engagement between the accessory mount and the muzzle adapter when the locking ring is not used.

Optionally, a gas seal between the muzzle adapter and the accessory mount can be included to prevent or reduce combustion gases from fouling the threads and other surfaces in the assembly. For example, the distal end of the adapter body has a tapered sealing surface that engages a corresponding taper on the inside of the accessory mount.

In some embodiments, the attachment assembly optionally includes a retention ring that couples the locking nut to the accessory mount. In one embodiment, the retention ring is a split retaining ring, circlip, C-ring, or the like that is seated in a circumferential groove in the inside of the locking nut. A radially outer portion of the retaining ring extends into a neck portion of the accessory mount, which has a reduced diameter compared to the adjacent threaded portion. For example, the neck portion is between a suppressor mount and the suppressor body. When installed, the retaining ring extends both radially into the locking nut and radially into the neck region, overlapping a portion of each component, to inhibit or block disassembly of the locking nut from the mount.

General Overview

Suppressors, muzzle brakes, flash hiders, and other accessories can be mounted to the muzzle of a firearm barrel and often have a structure that redirects, slows down, or otherwise interacts with propellant gases exiting the barrel upon discharge of the firearm. Some firearm muzzle accessories include a relatively short inside taper that engages a corresponding outside taper on the muzzle adapter when the accessory is threaded onto the muzzle adapter. The taper can facilitate alignment of the accessory with the bore axis of the firearm. The taper can also be useful to form a seal that prevents combustion byproducts from leaking through the joint and fouling interface surfaces. The sealing taper creates a binding condition as the suppressor is tightened. To augment the hold of a threaded interface, sealing tapers of relatively shallow angles have been used as a secondary retention mechanism to retain the suppressor on the barrel.

A challenge of such sealing tapers is that the taper seal can loosen when heated if the two components have different thermal expansion coefficients, or have different local temperatures, rendering the sealing tapers unreliable to retain the muzzle accessory on the barrel. For some firearms, such as machine guns, the muzzle and suppressor can be heated to 700° F. and beyond due to prolonged and heavy firing. Such heat can result in failure of the taper seal, rendering the seal ineffective to retain the suppressor on the muzzle adapter. As noted above, additional torque is sometimes applied in an attempt to tighten the joint and prevent the seal breaking during thermal cycling. In doing so, however, the sealing taper tightly binds the suppressor mount to the muzzle adapter. Such torque, in combination with high heat, can make it nearly impossible to later remove the suppressor, such as after prolonged heavy fire that is common with machine guns. For machine guns and other firearms having quick-change barrels, the suppressor often needs to be removed and reinstalled on another barrel, so a seal that is nearly impossible to undo is problematic, as will be appreciated.

Other secondary latch mechanisms have been used in an attempt to remedy the reliability challenges of the sealing taper as a secondary retention mechanism, but such secondary latches can be complicated, are prone to fouling, wear, and failures, and usually require the operator to perform additional acts to engage or release the latch. The use of a secondary latch mechanism therefore complicates the installation and removal of the accessory and requires additional training for the operator to quickly and successfully install or remove the accessory under adverse conditions, such as darkness or under duress. Accordingly, a need exists for an improved mount and retention assembly for muzzle attachments such as suppressors.

It would be desirable to have a mounting assembly that securely retains the accessory on the barrel, resists loosening due to recoil forces and heat cycles, and at the same time allows the user to remove the accessory without undue complication. The present disclosure addresses this need and others by providing a mounting and retention assembly that enables firearm muzzle attachments to be positively retained to the host firearm.

In accordance with one embodiment, a mounting assembly includes a locking nut and a locking ring, where the mounting assembly is configured to be coupled to the accessory mount of a muzzle accessory, such as a suppressor. The mounting assembly is configured to function as a secondary retention mechanism when the accessory is attached to a muzzle adapter on a firearm barrel, such as by threaded engagement. In one example, the outside of the accessory mount has male threads for threaded engagement with the locking nut. The outside surface of the muzzle adapter also has a bearing surface located proximally of the outside threads. The locking nut includes female threads to engage the accessory mount, and also includes an inside taper located proximally of the female threads. When the locking nut is tightened onto the accessory mount, the locking ring becomes bound between the inside taper of the locking nut and the bearing surface on the muzzle adapter. This retention mechanism has been shown to reliably retain the muzzle accessory threaded onto the muzzle adapter. In contrast to sealing tapers used in some muzzle attachments, the locking ring can be unseated from the bearing surface when the locking nut is unscrewed from the accessory mount. For example, the locking ring is configured to enable expansion or compression. As such, the locking ring can be slightly expanded in circumferential size to break the joint when the locking nut is loosened.

In accordance with some embodiments, the disclosed attachment assembly or methods of use may be detected, for example, by visual inspection of mounting assembly that includes a locking ring on the inside of a locking nut. For example, the mounting assembly can be used with a suppressor mount when installing the suppressor on the muzzle adapter such that the locking ring becomes bound between the muzzle adapter and the locking nut when the muzzle accessory is installed on the barrel and the locking nut is tightened to the accessory mount.

As will be appreciated in light of this disclosure, and in accordance with some embodiments, features of the muzzle attachment assembly in accordance with present disclosure can be used to removably secure and retain muzzle devices on the barrel of a rifle, machine gun, submachine gun, pistol, or other firearm. Some embodiments of the muzzle attachment assembly are particularly suited for securing a suppressor to a barrel of a machine gun. Some embodiments of the accessory mount can be integrally attached to or formed with a muzzle accessory, such as a suppressor. In other embodiments, the accessory mount is constructed to be removably attached to a muzzle accessory, such as a suppressor, heat shield, flash hider, or other device. As will be further appreciated, the particular configuration (e.g., materials, dimensions, etc.) of an attachment assembly configured as described herein may vary depending on whether the intended use is military, tactical, sport, or civilian in nature. Numerous configurations will be apparent in light of this disclosure.

Structure and Operation

Figure 2:
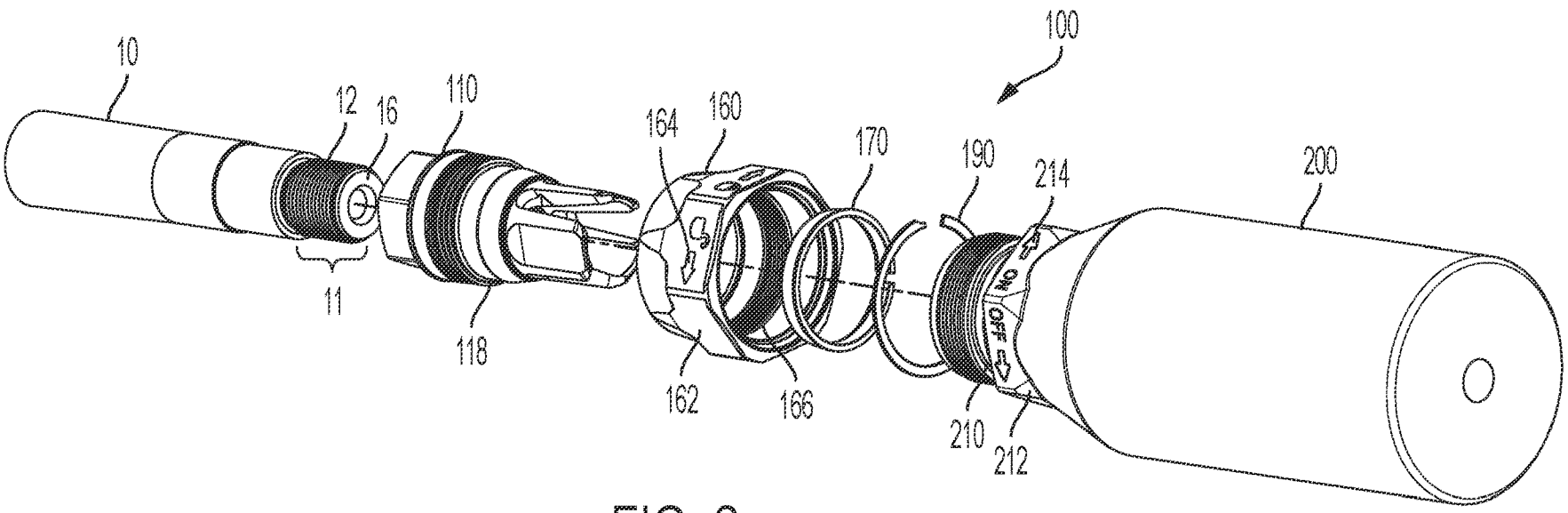
FIG. 2 illustrates an exploded, front perspective view showing components of a mounting assembly along with part of a firearm barrel, a muzzle adapter, and a suppressor, in accordance with an embodiment of the present disclosure.

FIGS. 1-2 illustrate various view of a mounting assembly 100 in use with a muzzle accessory 200 and firearm barrel 10, in accordance with an embodiment of the present disclosure. FIG. 1 is a side view showing the mounting assembly 100 and portions of the muzzle accessory 200 and barrel 10. FIG. 2 is an exploded front perspective view showing components of the mounting assembly 100, barrel 10, muzzle adapter 110, and accessory 200 spaced along the bore axis 14. In this example, the mounting assembly includes a locking nut 160, a locking ring 170, and an optional retaining ring 190. The muzzle adapter 110 (e.g., a flash hider) can be threaded onto the distal end portion 11 of the barrel 10 and tightened sufficiently so as to prevent it from coming loose due to recoil forces, thermal cycling, and the like. For example, a wrench can be used to secure the muzzle adapter 110 to the barrel 10. In some embodiments, a flash hider or other attachment can be secured the muzzle adapter 110, such as by threaded engagement.

The muzzle accessory 200 (or simply "accessory") can be attached to the muzzle adapter 110, such as by threading the accessory 200 onto the muzzle adapter 110. The mounting assembly 100 can be used with the accessory mount 210 to prevent inadvertent loosening of the accessory 200 when it is installed on the muzzle adapter 110 by binding the locking ring 170 between the locking nut and the muzzle adapter 110. When present, the retaining ring 190 can be installed between the accessory mount 210 and the locking nut 160 to retain the locking nut 160 on the accessory 200. The retaining ring 190 can be a snap ring, which may also be referred to as a circle clip, circlip, or C-clip, in accordance with some embodiments.

In this example, the accessory 200 is a suppressor that includes an accessory mount 210 on its proximal end. The mounting assembly 100 is not limited to a suppressor and other accessories 200 can be similarly mounted as described herein, as will be appreciated. The accessory mount 210 optionally includes wrench flats 212 to facilitate installation and removal of the accessory 200. The accessory mount 210 also optionally includes an indicator 214 that shows the direction of rotation for installing and removing the accessory 200 from the barrel 10.

The locking nut 160 also may include wrench flats 162 and a direction indicator 164 to indicate the direction of rotation for tightening or loosening the locking nut 160. Note that in this example, the locking nut 160 loosens and tightens in the same rotational direction about the bore axis 14 as does the accessory mount 210. For example, the female threads 218 (not visible) on the inside of the accessory mount 210 are right-hand threads for engaging male threads 118 on the muzzle adapter 110. In order for the locking nut 160 to tighten in the same rotational direction as the accessory mount 210, the female threads 166 on the inside of the locking nut 160 are left-hand threads. The components including the right-hand and left-hand threads can be reversed in some embodiments.

Figure 3:
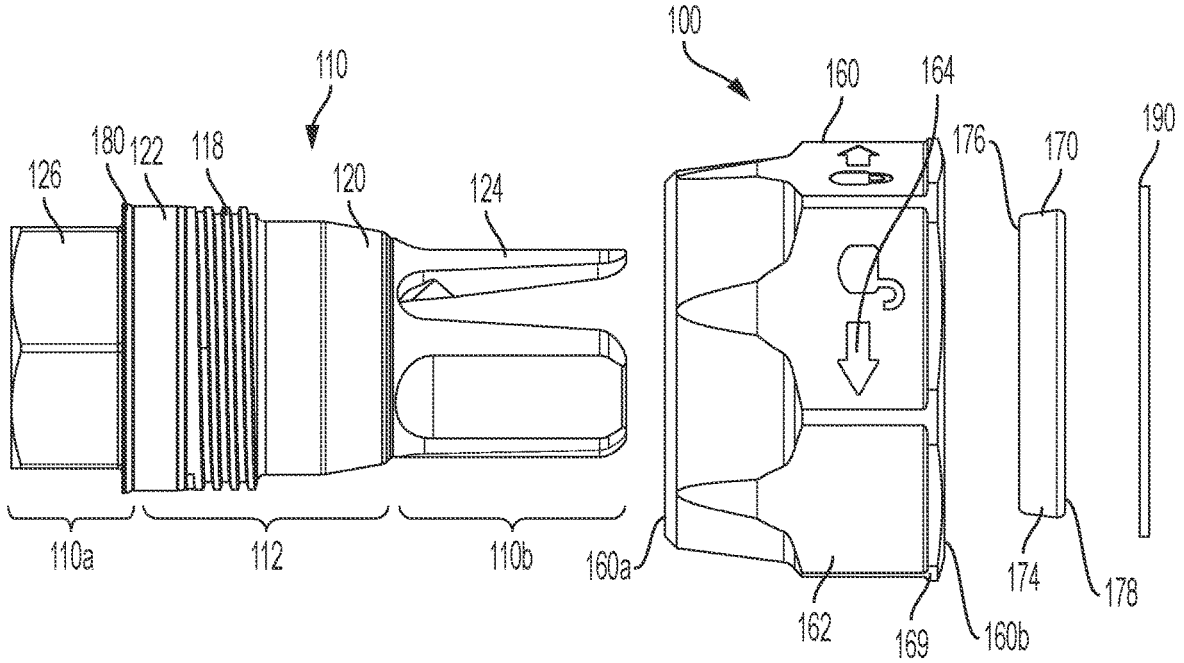
FIG. 3 illustrates an exploded side view showing components of a mounting assembly together with a muzzle adapter, in accordance with an embodiment of the present disclosure.
Figure 4:
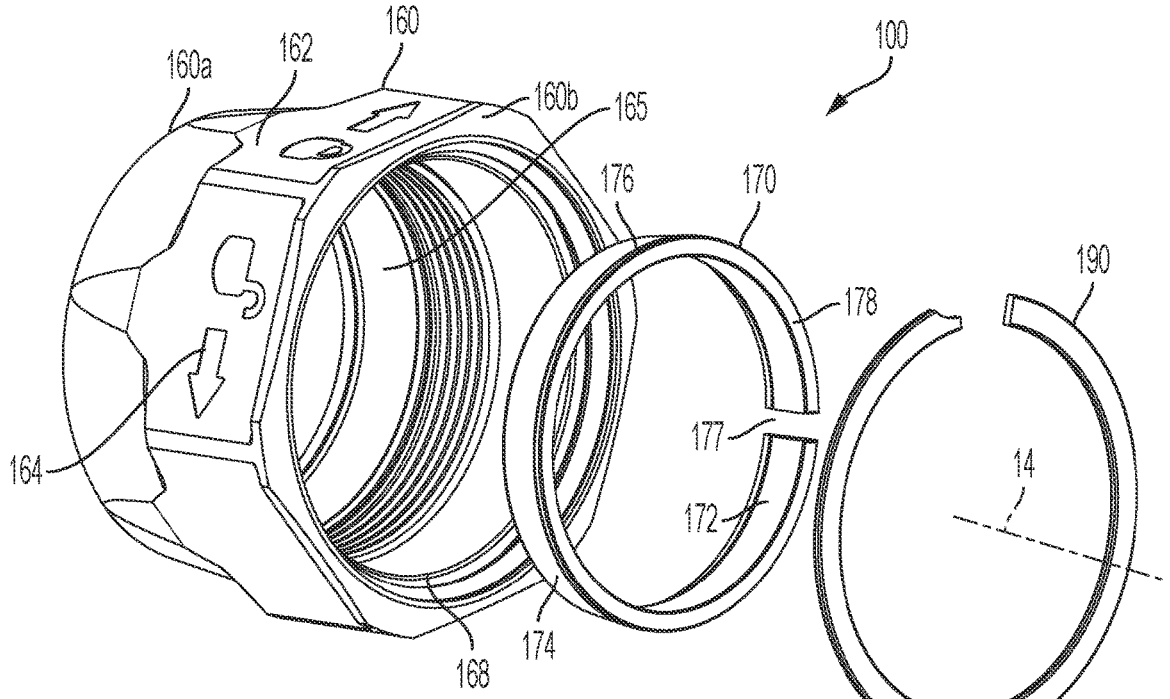
FIG. 4 illustrates an exploded, front perspective view showing components of the mounting assembly of FIG. 3.

Referring now to FIGS. 3 and 4, an exploded side view and an exploded front perspective view, respectively, show components of the mounting assembly 100, in accordance with an embodiment. In FIG. 3, the mounting assembly 100 is shown together with a muzzle adapter 110 configured as a flash hider. The locking nut 160 has a generally annular geometry with female threads 166 on the inside and wrench flats 162 on the outside. In this example, the female threads 166 are left-hand threads to simplify operation as discussed above, but this is not required. In this example, the locking nut 160 also includes the optional direction indicator 164 showing the direction of rotation to loosen/unlock and to tighten/lock the locking nut 160. When left-hand threads 166 are used on the inside of the locking nut 160, the direction indicator 164 is useful to the user since left-hand threads require rotation in a contrary direction to right-hand threads that are used in many threaded features, as will be appreciated.

Adjacent the distal end **160*b*, the locking nut 160 optionally includes a raised flange 169 that protrudes radially outward beyond the wrench flats 162. In one example, the flange 169 has a hexagonal shape consistent with that of the wrench flats 162. In another example, the flange 169 is cylindrical. The flange 169 can be used to capture a wrench on the wrench flats 212 of the accessory mount 210. For example, when a suppressor is removed from the barrel while hot, the flange 169 enables the user to handle and carry the hot suppressor using the wrench on the wrench flats 212**.

In this example, the locking nut 160 defines a tapered inside surface 165 corresponding to the tapered outer surface 174 of the locking ring 170. The locking nut 160 optionally defines a circumferential groove 168 adjacent the central distal opening to accommodate the retaining ring 190. The tapered inside surface 165 is adjacent the proximal end 160*a* of the locking nut 160 and the circumferential groove 168 is adjacent the distal end 160*b* of the locking nut 160. In some embodiments, the tapered inside surface 165 and the tapered outer surface 174 both have the same included taper angle (or approximately the same included angle, such as ±1° or ±2°) from 10° to 30° with respect to the bore axis 14.

The muzzle adapter 110 has an adapter body 112 that extends along the bore axis 14 and includes male threads 118 on the outside surface. The male threads 118 are located between a bearing surface 122 and an outer sealing taper 120. The bearing surface 122 can be cylindrical or can have a shallow taper. In some embodiments, the outer sealing taper 120 has an included taper angle of 10-30°, or about 20°. The included taper angle of the outer sealing taper 120 and other included taper angles can be measured, for example, as the angle defined by lines parallel to opposite sealing surfaces of the frustoconical taper. For example, a top surface defines an angle of 12° with the bore axis 14, the bottom surface defines an angle of 12° with the bore axis 14, and the included taper angle is 24°. The adapter body 112 can include optional wrench flats 126 on the proximal end portion 110*a* to enable tightening the muzzle adapter 110 to the barrel 10 using a wrench. The adapter body 112 includes female threads 114 on an inside of the bore 116, the female threads 114 configured to threadably engage the threads 12 on the barrel 10 (shown in FIG. 2). The muzzle end 16 of the barrel 10 contacts the end of the bore 116 in the muzzle adapter 110 when tightened fully, in accordance with some embodiments.

In some embodiments, the muzzle adapter 110 includes an optional flow-directing feature 124 at the distal end portion 110*b*. In this example, the muzzle adapter 110 is configured as a three-prong flash hider and includes prongs extending distally from the adapter body 112, where the prongs have a circumferentially spaced-apart arrangement to control expansion of combustion gases exiting the barrel 10. In other embodiments, the flow-directing feature 124 can be an expanding passageway or a flash hider having longitudinal slots or other perforations defined in an otherwise generally cylindrical body, such as a "birdcage" flash hider. In yet other embodiments, the flow-directing feature 124 is a blast diffusor. Other flow-directing features 124 can be used and can be selected to control the expansion of combustion gases going into the muzzle accessory 200 (e.g., a suppressor). In yet other embodiments, the muzzle adapter 110 can be some other muzzle attachment (e.g., a recoil compensator) or simply an intermediate component between the barrel 10 and the accessory mount 210, such as an adapter fitting. In still other embodiments, the muzzle adapter 110 is omitted and the accessory 200 can be mounted directly to the barrel 10 in similar fashion as described and using the other components of the mounting assembly 100. For example, the locking ring 170 becomes bound between the barrel 10 and the tapered inside surface 165 of the locking nut 160.

In accordance with some embodiments, the locking ring 170 is configured to enable a change in circumferential size. For example, the locking ring 170 has an annular hoop-like shape with a relatively smaller radial thickness compared to the axial length, where the hoop-like shape defines a break along its circumference. The locking ring 170 has an inner surface 172 that is configured to engage the bearing surface 122 of the muzzle adapter 110, whether parallel to the bore axis 14 or tapered with respect to the bore axis 14. The locking ring 170 has a tapered outer surface 174 that results in a decreasing ring thickness towards the proximal end 176 of the locking ring 170 compared to the distal end 178. The tapered outer surface 174 results in an asymmetrical cross-sectional shape of the locking ring 170. The tapered outer surface 174 has a taper angle that is about the same as (e.g., ±2°) the taper angle of the tapered inside surface 165, with respect to the central axis 14. In some embodiments, the locking ring 170 is a split ring that completes less than 360° of a circle, such as being continuous along 340°-355° of a circle. In the example shown, the locking ring 170 has a break 177 along the circumference, which allows for compression and expansion of the ring diameter. The locking ring 170 has an outer diameter in its resting state that is larger than the inside of the locking nut 160. When the locking ring 170 is installed in the locking nut 160 (e.g., in a compressed state), is expands towards the larger resting size and contacts the tapered inside surface 165 of the locking nut 160. As such, the locking ring 170 is retained inside the locking nut 160 and remains with the locking nut 160 during installation and removal from the muzzle adapter 110. In this example, the muzzle adapter 110 also includes a sloped circumferential lip 180 that prevents the locking ring 170 from sliding off of the adapter body 112 when the locking nut 160 is being unscrewed during unlocking of bound tapers. When the locking nut 160 is tightened onto the accessory mount 210, the locking ring 170 is pushed down the circumferential lip 180 and into engagement with the bearing surface 122 on the muzzle adapter 110. Use of the mounting assembly 100 with a muzzle accessory 200 is discussed in more detail below.

The locking nut 160 includes a retaining ring 190 to couple the locking nut 160 to the accessory mount 210. The retaining ring 190 is configured to be seated in circumferential groove 168 on the inside of the locking nut 160. In one example, the retaining ring 190 is configured as a snap ring having an annular shape with relatively narrow axial thickness and relatively greater radial width. The retaining ring 190 is configured to be expandable and compressible between larger and smaller circumferences, as will be appreciated. In some embodiments, the retaining ring 190 is sized to be received in a compressed state in the circumferential groove inside the locking nut 160. Retaining ring 190 is discussed in more detail below.

Figure 5:
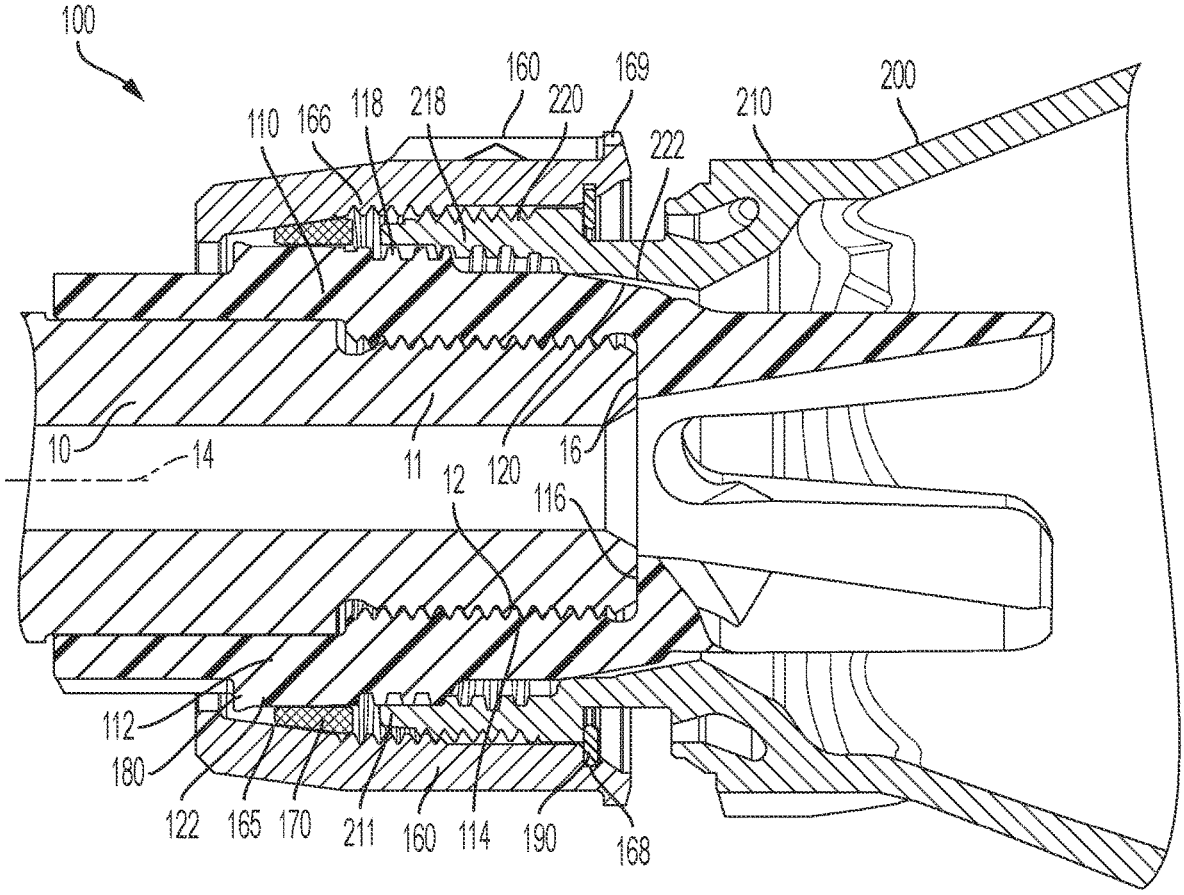
FIG. 5 illustrates a side view showing a longitudinal section of a mounting assembly and portions of a barrel and suppressor, where the suppressor is loosened with respect to the muzzle adapter and the locking nut is loosened with respect to the suppressor mount, in accordance with an embodiment of the present disclosure.
Figure 6:
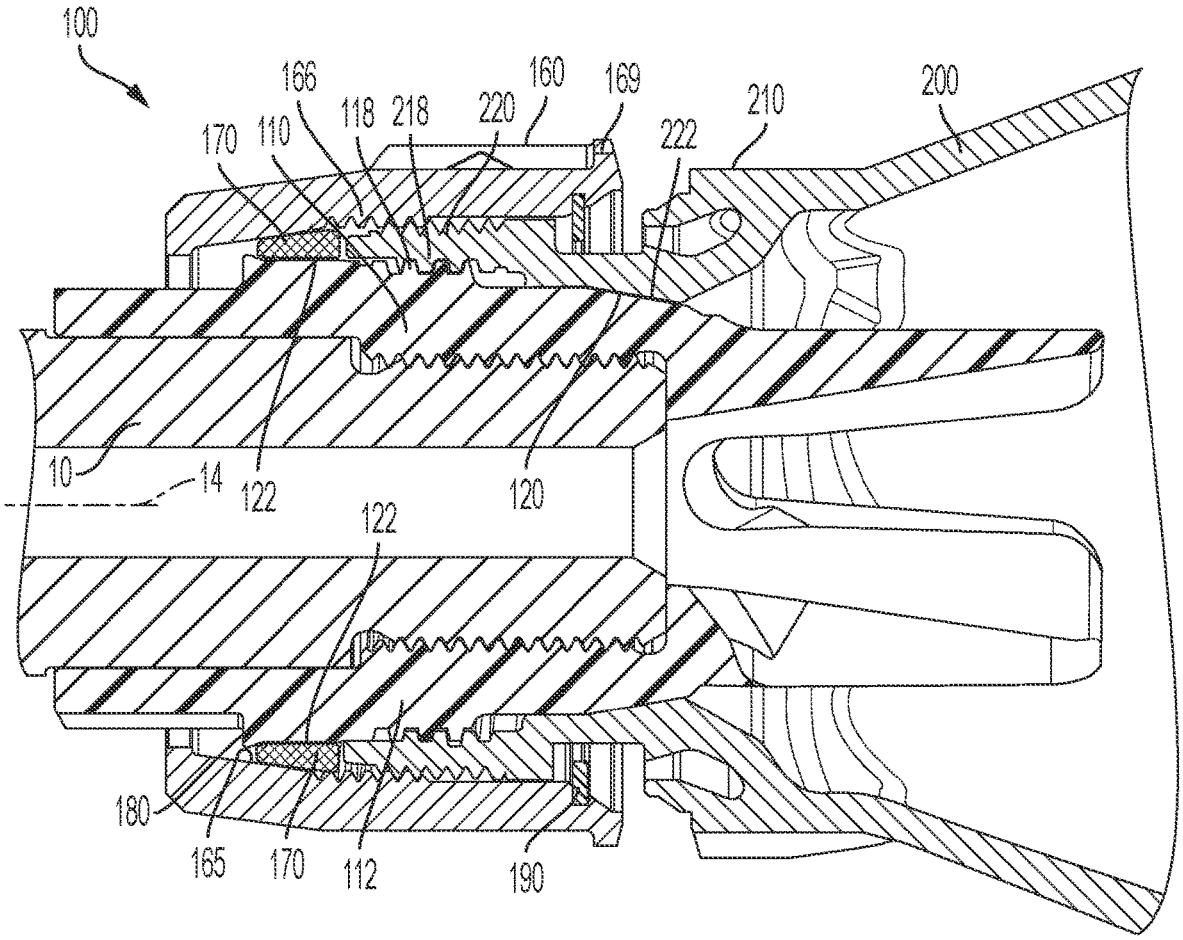
FIG. 6 illustrates a side view showing a longitudinal section of a mounting assembly and portions of a barrel and suppressor, where the suppressor is tightened with respect to the muzzle adapter and the locking nut is loosened with respect to the suppressor mount, in accordance with an embodiment of the present disclosure.
Figure 7:
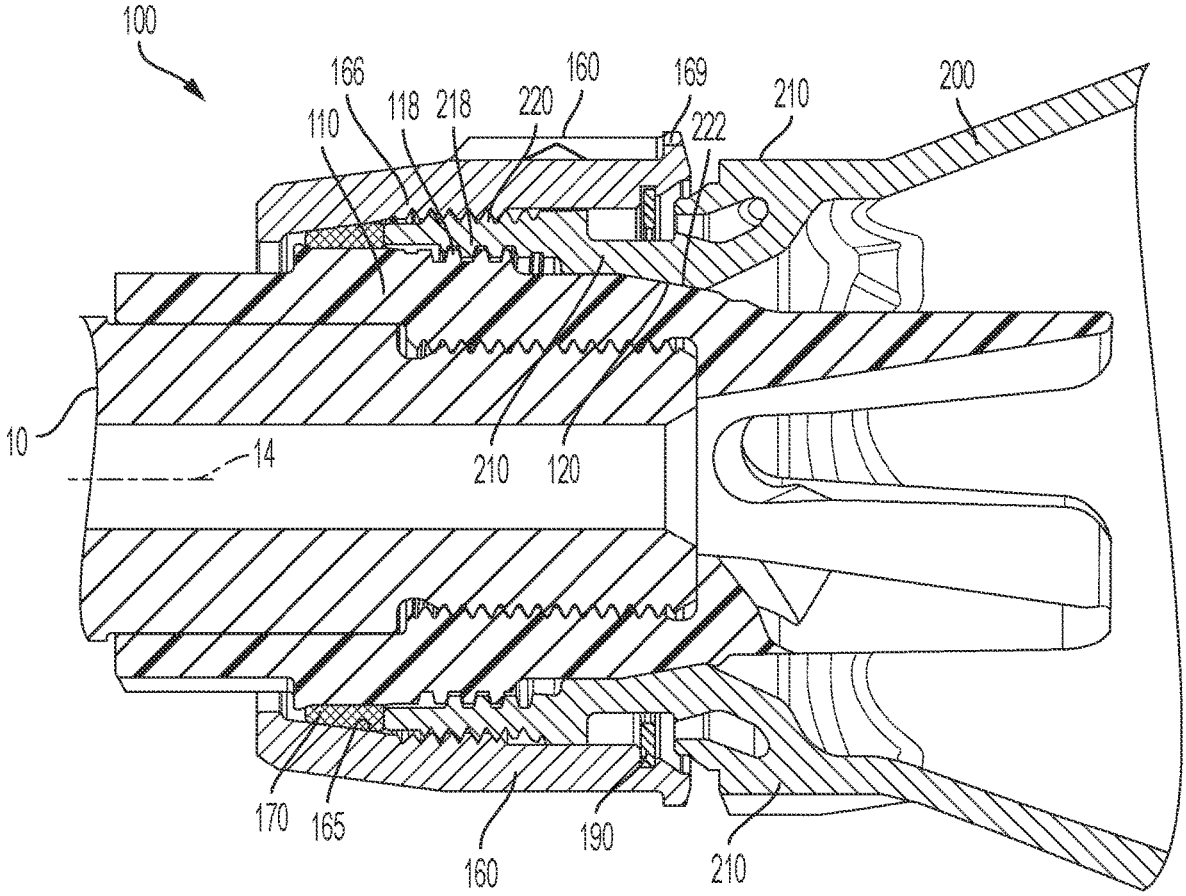
FIG. 7 illustrates a side view showing a longitudinal section of a mounting assembly and portions of a barrel and suppressor, where the suppressor is tightened with respect to the muzzle adapter and the locking nut is tightened with respect to the suppressor mount, in accordance with an embodiment of the present disclosure.

Referring now to FIGS. 5-7, side views show longitudinal sections of mounting assembly 100 with an accessory 200 in various stages of installation on a barrel 10. In FIG. 5, the muzzle adapter 110 is securely attached to the barrel 10 as indicated by the engagement between threads 12 on the barrel with female threads 114 on the inside of the muzzle adapter 110. Also, the muzzle end 16 of the barrel 10 engages the end of the bore 116, resulting in a binding condition between threads 12, 114 such that muzzle adapter 110 is unlikely to come loose due to recoil forces, thermal cycling, and other effects of using the firearm.

The accessory 200, a suppressor in this example, is only partially installed onto the muzzle adapter 110. One such condition is when the muzzle adapter 110 (with locking ring 170 around bearing surface 122) is first inserted into the locking nut 160 and accessory mount 210. As shown in FIG. 5, the retaining ring 190 is seated in the circumferential groove 168 in the inside of the locking nut 160. A radially inner portion of the retaining ring 190 overlaps the accessory mount 210. By doing so, the retaining ring 190 acts as an axial stop to prevent the locking nut 160 from separating from the accessory mount 210. In the position shown, where the retaining ring 190 contacts the accessory mount 210, the retaining ring 190 prevents the locking nut 160 from moving further away from the accessory 200 along the bore axis 14.

As can be seen in FIG. 5, female threads 218 on the inside of the accessory mount 210 have begun to engage the male threads 118 on the muzzle adapter 110. Similarly, the locking nut 160 is only partially installed as indicated by female threads 166 starting to engage the male threads 220 on the accessory mount 210. In addition to only partial engagement between threads, a gap exists between the inner taper 222 on the inside of the accessory mount 210 and the outer sealing taper 120 on the muzzle adapter 110.

Also note in FIG. 5 that the locking ring 170 is axially spaced both from the end 211 of the accessory mount 210 and from both the circumferential lip 180 on the adapter body 112. The locking ring 170 occupies a distal portion of the bearing surface 122. Further, a small radial gap exists between the locking ring 170 and the bearing surface 122. Accordingly, the locking ring 170 is in a non-binding condition between the bearing surface 122 and the tapered inside surface 165 of the locking nut 160.

Referring to FIG. 6, the accessory 200 has been threaded further onto and tightened to the muzzle adapter 110 so that the inner taper 222 of the accessory mount 210 engages the outer sealing taper 120 on the muzzle adapter 110. The locking nut 160 is still relatively loose and is not tightened onto the accessory mount 210. As shown here, the accessory mount 210 (and locking nut 160) have advanced proximally along the muzzle adapter 110 so that more of the male threads 118 on the muzzle adapter 110 engage female threads 218 of the accessory mount 210. As the locking nut 160 is tightened onto the accessory mount 210, the locking ring 170 rotates and moves axially with the locking nut 160. As the locking nut 160 is further advanced, the end 211 of the accessory mount 210 contacts the locking ring 170 and prevents the locking ring 170 from moving further axially. Further rotation of the locking nut 160 drives the tapered outer surface 174 of the locking ring 170 along the tapered inside surface 165 of the locking nut 160 and compresses the locking ring 170 until the locking ring 170 contacts the bearing surface 122 and becomes bound between the bearing surface 122 and the tapered inside surface 165. Also, the retaining ring 190 no longer contacts the accessory mount since the locking nut 160 has advanced (distally) onto the accessory mount 210.

Referring to FIG. 7, the locking nut 160 has been tightened onto the accessory mount 210 to prevent inadvertent loosening of the accessory 200 from the barrel 10. As the locking nut 160 is tightened, it moves distally along the muzzle adapter 110 so that the bearing surface 122 engages and binds with the inside surface of the locking ring 170. As the tapered inside surface 165 moves against the locking ring 170, the inside diameter continues to get smaller and the tapered inside surface 165 more tightly engages the locking ring 170 until the locking nut 160, locking ring 170, and accessory mount 210 bind. The binding condition restricts the locking nut 160 from coming loose, and therefore also restricts the accessory 200 from coming loose.

Figure 8A:
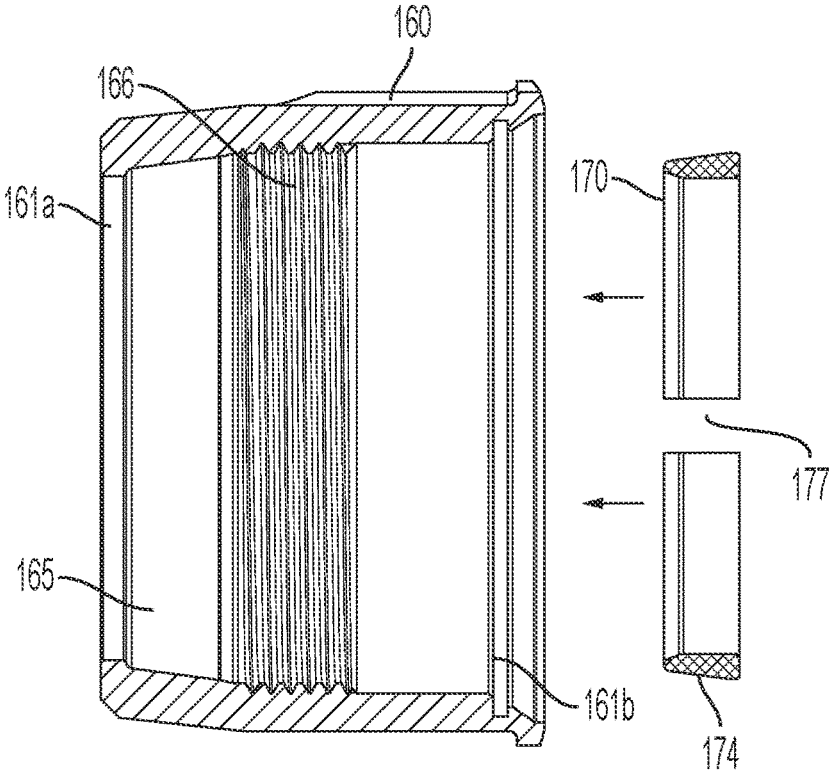
FIGS. 8A and 8B illustrate side views showing a longitudinal section of a locking nut and locking ring at various stages of installing the locking ring in the locking nut, in accordance with some embodiments of the present disclosure.
Figure 8B:
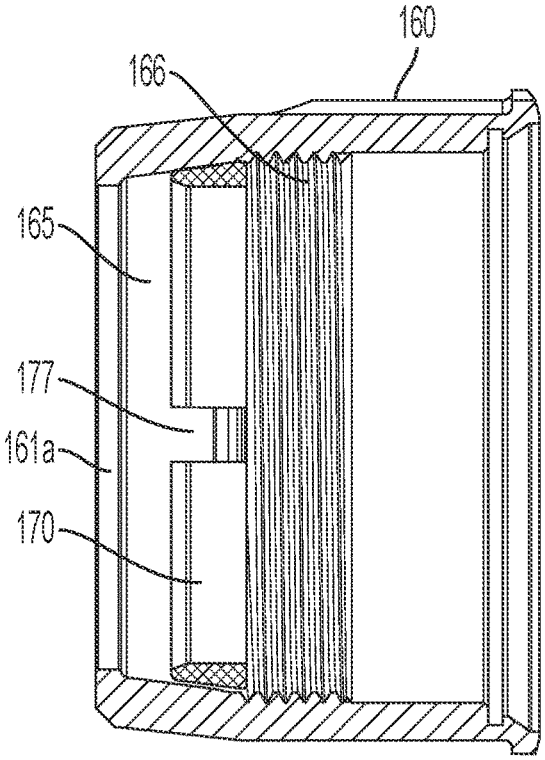

Referring now to FIGS. 8A and 8B, side views show longitudinal sections of the locking nut 160 and locking ring 170 before and after assembly of the locking ring 170 into the locking nut, in accordance with one embodiment. In FIG. 8A, the locking ring 170 is a hoop-shaped retaining ring defining a break 177. The locking ring 170 has been compressed to have a smaller diameter so that it can pass through the distal opening 161*b* of the locking nut 160. While in the compressed state, the locking ring 170 is inserted through the distal opening 161*b* and then is advanced past the female threads 166 until the outside surface 174 of the locking ring 170 engages the tapered inside surface 165 in the locking nut 160 while still under some compression. The locking ring 170 is then released and the remaining compression urges the outside surface 174 into contact with the tapered inside surface 165 of the locking nut 160. Note that the proximal opening 161*a* of the locking nut 160 has a shoulder of reduced diameter to prevent the locking ring 170 from passing through the proximal opening 161*a*.

Referring now to FIGS. 9A-9D, assembly of the locking nut 160, locking ring 170, retaining ring 190, and muzzle accessory 200 is now discussed. In some embodiments, mounting assembly 100 may be provided as a kit that can be assembled by the user. In one such embodiment, the locking nut 160, locking ring 170, and retaining ring 190 are assembled with the accessory 200 prior to installing the accessory 200 on the muzzle adapter 110 or barrel 10. In this example, a retaining ring 190 is used to couple the locking nut 160 to the accessory mount 210; however, other structures can be used, such as a set screw or pin extending radially into the neck portion 215 of the accessory mount 210, or a cross pin that occupies the neck portion 215 of the accessory mount 210.

Figure 9A:
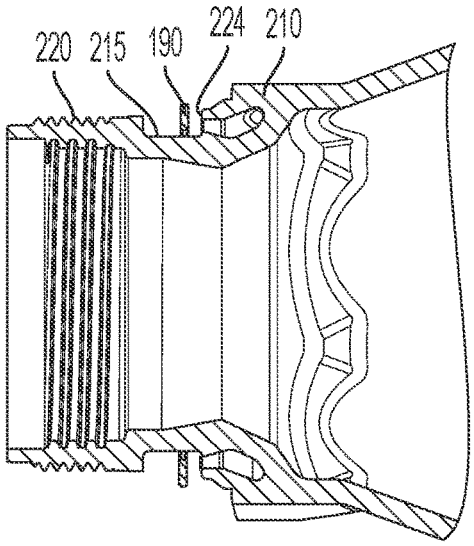
FIGS. 9A-9D illustrate side views showing a longitudinal section of an accessory mount and a mounting assembly that includes a locking nut, locking ring, and a split retaining ring, where the accessory mount and mounting assembly are shown in various stages of assembling the mounting assembly with the accessory mount, in accordance with some embodiments of the present disclosure.

As shown, for example, in FIG. 9A, the retaining ring 190 is installed on the neck portion 215 of the accessory mount 210. When the retaining ring 190 is a circlip or the like, the retaining ring 190 can be opened to have a larger diameter to receive the neck portion 215. For example, the retaining ring 190 is opened by hand or by using a tool configured for doing so, as will be appreciated. In the expanded state, the retaining ring 190 can be installed on the neck portion 215 of the accessory mount 210 by placing it over the male threads 220 and onto the neck portion 215, which has a reduced diameter compared to the male threads 220. The retaining ring 190 is then allowed to return towards its resting size. In this example, the retaining ring 190 is configured to have a resting size inner diameter that is greater than the outer diameter of the neck portion 215, and to have a resting size outer diameter that is greater than the inner diameter of the circumferential groove 168 of the locking nut 160. In other embodiments, the retaining ring 190 can have a resting size outer diameter that is equal to or less than the diameter of the circumferential groove 168, so long as the retaining ring 190 can be sufficiently seated in the circumferential groove 168, as will be appreciated. Installing the retaining ring 190 on the neck portion 215 can be performed before or after installing the locking ring 170 in the locking nut 160.

Figure 9B:
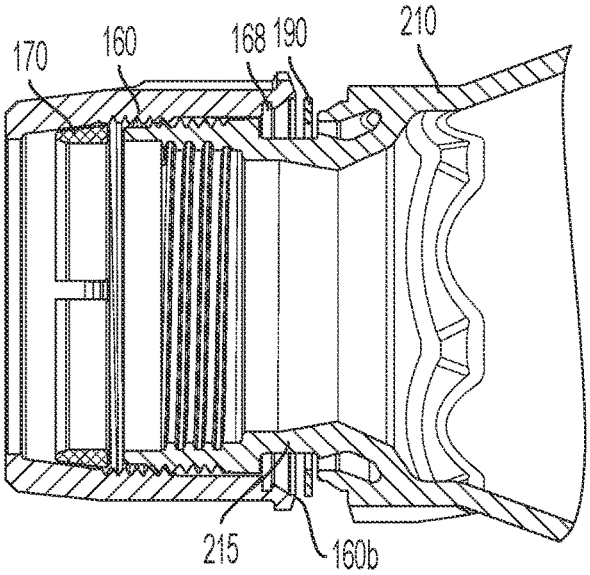
Figure 9C:
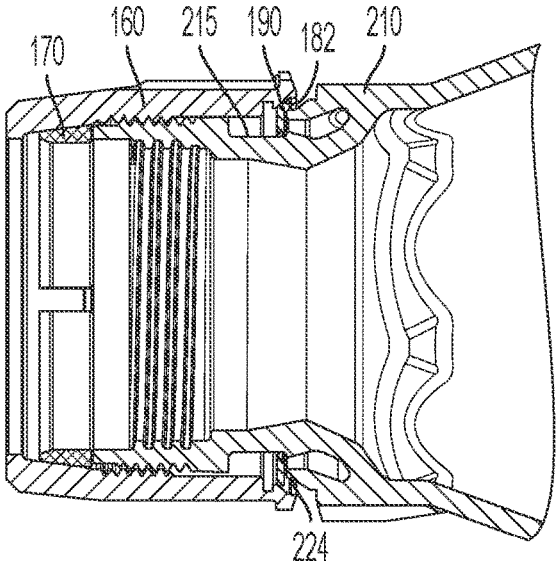
Figure 9D:
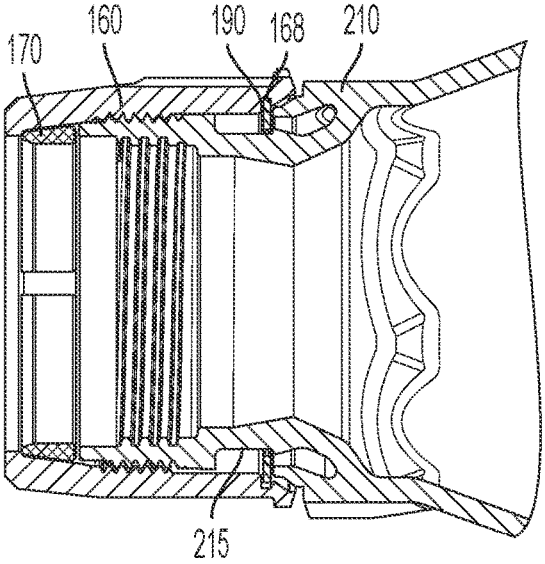

Next, the locking nut 160 with the locking ring 170 inside is threaded onto the accessory mount 210, such as shown in FIG. 9B. The locking nut 160 is advanced further to move the retaining ring 190 into contact with a sloped entrance face 182 adjacent the distal end 160*b* of the locking nut 160. As the locking nut 160 is advanced still further, the retaining ring 190 contacts a shoulder 224 on the accessory mount 210, causing the retaining ring 190 to be compressed and pushed down the sloped entrance face 182, such as shown in FIG. 9C, until the retaining ring 190 is positioned to expand and seat in the circumferential groove 168 of the locking nut 160, such as shown in FIG. 9D. In this seated position, the retaining ring 190 maintains the locking nut 160 with the accessory mount 210 by overlapping portions of both the locking nut 160 and the accessory mount 210. After seating the retaining ring 190 in the circumferential groove 168, the locking nut 160 is unthreaded to a loosened position prior to installing the accessory 200 on the firearm barrel 10.

Figure 10:
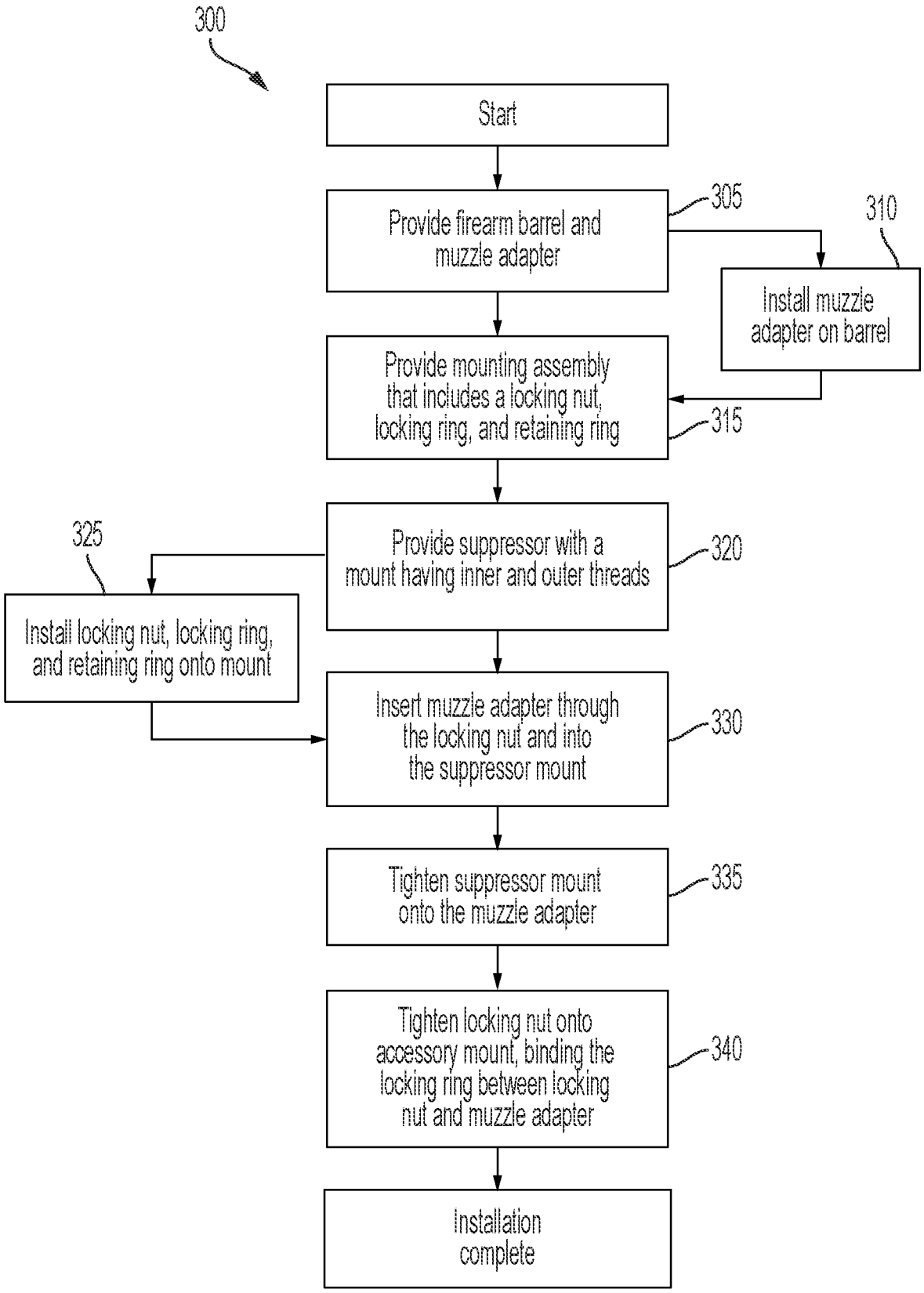
FIG. 10 illustrates a flow chart for a method of installing and retaining a suppressor on a firearm barrel, in accordance with an embodiment of the present disclosure.

Referring now to FIG. 10, a flowchart illustrates a method 300 of installing and retaining a suppressor on a firearm barrel 10, in accordance with some embodiments. Although method 300 is described for a suppressor as the muzzle accessory, method 300 can be applied to other muzzle accessories 200, as will be appreciated. Examples of the mounting assembly and suppressor mount are discussed above.

Method 300 begins with providing 305 a firearm barrel and muzzle adapter, providing 315 a mounting assembly that includes a locking ring, a retaining ring, and a locking nut, and providing 320 a suppressor with a suppressor mount having inner and outer threads. The suppressor and the mounting assembly can be provided together or separately. In some such embodiments, part of the mounting assembly (e.g., a locking nut, a locking ring and a retaining ring) can be installed 312 on the suppressor mount in preparation for installing the suppressor on the firearm barrel. In other embodiments, the locking nut (with locking ring inside) is placed on the barrel and coupled to the suppressor mount and retaining ring as part of installing the suppressor on the barrel.

In some embodiments, method 300 includes installing 310 the muzzle adapter on the firearm barrel. In one example, the muzzle adapter is threaded onto the barrel and tightened until the muzzle end of the barrel "bottoms out" in the bore of the muzzle adapter. In some embodiments, the muzzle adapter can be secured to the barrel by welding, using adequate torque, or other suitable methods. In other embodiments, the muzzle adapter is already installed on the barrel, such as when the firearm is supplied with the muzzle adapter and installing 310 the muzzle adapter is not performed.

As needed, method 300 continues with installing 325 the locking ring, locking nut, and retaining ring on the suppressor mount. In one example, the locking ring is installed into the locking nut with the tapered outer surface engaging the tapered inside surface of the locking nut. The locking nut (with locking ring) is then coupled to the suppressor mount by first installing the retaining ring on the neck portion of the suppressor mount, and then threading the locking nut onto the suppressor mount to seat the retaining ring in a circumferential groove in the distal end of the locking nut. In some embodiments, the locking ring and locking nut are already installed on the suppressor mount. Also, in some embodiments, the retaining ring is not used or is replaced with some other structure for coupling the locking nut to the suppressor mount.

Method 300 continues with inserting 330 the barrel and muzzle adapter through the locking nut and into the accessory mount. The suppressor is then tightened 335 to the muzzle adapter until the inner taper forms a seal with the outer sealing taper on the muzzle adapter. A wrench can be used as desired, where the wrench engages the wrench flats on the accessory mount. Compared to traditional methods of securing a suppressor to the muzzle adapter or barrel, method 300 requires less torque since the mounting assembly provides a secondary retention mechanism with the locking ring and locking nut that function to retain the suppressor on the barrel.

Method 300 continues with tightening 340 the locking nut onto the suppressor mount until the locking ring is bound between the bearing surface on the muzzle adapter and the tapered inside surface of the locking nut. Optionally, the rotational position of the suppressor is maintained with respect to the barrel while tightening 340 the locking nut. In one example, one wrench is used to hold the suppressor steady while tightening the locking nut with a second wrench. For example, the first wrench is placed on the wrench flats of the suppressor mount and a second wrench is placed on the wrench flats of the locking nut. With the firearm in a vertical orientation, and while holding the suppressor stable with respect to the barrel, the locking nut is tightened 340 onto the suppressor mount. In some embodiments, tightening 340 the locking nut is performed in the same rotational direction as tightening 335 the suppressor mount onto the muzzle adapter.

The suppressor is now secured to the barrel and is ready for use. The suppressor can be removed from the barrel by unscrewing the locking nut, thereby breaking the joint formed by the locking ring. Next, the suppressor mount can be unthreaded from the muzzle adapter. When disengaged from the muzzle adapter, the suppressor can be removed. In some embodiments, the locking nut remains coupled to the suppressor mount due to the retaining ring or other retaining structure.

Further Example Embodiments

The following examples pertain to further embodiments, from which numerous permutations and configurations will be apparent.

Example 1 is a mounting assembly for a muzzle accessory and a muzzle adapter, the muzzle adapter having an adapter body with male threads and a bearing surface proximally adjacent the male threads, and the muzzle accessory having an accessory mount with an outside surface defining male threads and an inside surface defining female threads corresponding to the male threads on the muzzle adapter, the mounting assembly comprising a locking nut extending along a central axis from a proximal end to a distal end, the proximal end defining a central proximal opening and the distal end defining a central distal opening, the locking nut having an inside surface with female threads and an inside taper located proximally of the female threads, the female threads of the locking nut corresponding to the male threads on the accessory mount; and a locking ring having an inside face configured to engage the bearing surface on the muzzle adapter and having an outside face that includes an outside taper configured to engage the inside taper of the locking nut; wherein in an assembled state in which the accessory mount threadably engages the muzzle adapter, the locking nut is configured to be threaded onto the accessory mount with the locking ring engaging the bearing surface on the muzzle adapter and engaging the inside taper of the locking nut.

Example 2 includes the subject matter of Example 1, wherein the locking ring defines a break along a circumference of the locking ring.

Example 3 includes the subject matter of any of Examples 1-2, wherein the outside surface of the muzzle adapter includes an adapter outer sealing taper positioned distally of the male threads, wherein the inside surface of the accessory mount includes a mount inner sealing taper corresponding to the adapter outer sealing taper and is positioned distally of the female threads on the inside surface of the accessory mount, and wherein in the assembled state the adapter outer sealing taper sealingly engages the mount inner sealing taper.

Example 4 includes the subject matter of any of Examples 1-3, wherein the inside taper defines an included first taper angle with respect to the central axis and the outside taper defines an included second taper angle with respect to the central axis, the included first taper angle consistent with the included second taper angle.

Example 5 includes the subject matter of Example 4, wherein each of the included first taper angle and the included second taper angle is from 5 to 60 degrees.

Example 6 includes the subject matter of Example 4, wherein each of the included first taper angle and the included second taper angle is from 15 to 30 degrees.

Example 7 includes the subject matter of any of Examples 1-6, wherein the inside face of the locking ring is substantially parallel (e.g., ±2°) to the bearing surface on the muzzle adapter.

Example 8 includes the subject matter of Example 7, wherein the inside face of the locking ring and the bearing surface have matching tapers.

Example 9 includes the subject matter of any of Examples 1-7, wherein the inside face of the locking ring is substantially parallel (e.g., ±2°) to the central axis.

Example 10 includes the subject matter of any of Examples 1-9, wherein the muzzle adapter defines a central bore, the central bore including threads.

Example 11 includes the subject matter of any of Examples 1-10, wherein the female threads on the inside surface of the accessory mount and male threads on the outside surface of the muzzle adapter are right-hand threads, and wherein the female threads on the inside surface of the locking nut and the male threads on the outside surface of the accessory mount are left-hand threads.

Example 12 includes the subject matter of any of Examples 1-10, wherein the female threads on the inside surface of the accessory mount and male threads on the outside surface of the muzzle adapter are left-hand threads, and wherein the female threads on the inside surface of the locking nut and the male threads on the outside surface of the accessory mount are right-hand threads.

Example 13 includes the subject matter of any of Examples 1-12 and further comprises a retaining structure between the locking nut ant the accessory mount, the retaining structure configured to couple the locking nut to the accessory mount.

Example 14 includes the subject matter of Example 13, wherein the retaining structure comprises a retaining ring between the locking nut and the accessory mount; wherein the accessory mount includes a neck portion positioned distally of the male threads, the neck portion having a reduced diameter compared to the male threads; wherein the inside surface of the locking nut defines a circumferential groove adjacent the distal end; and wherein a radially outer part of the retaining ring is in the circumferential groove and a radially inner part of the retaining ring is in the neck portion.

Example 15 includes the subject matter of Example 14, wherein the retaining ring is selected from one of a circlip, a split ring, a circle clip, a snap ring, or a C-clip.

Example 16 includes the subject matter of Example 13, wherein the accessory mount includes a neck portion of reduced diameter positioned distally of the male threads, and wherein the retaining structure comprises a pin or fastener between the locking nut and the accessory mount, wherein part of the pin or fastener is adjacent the reduced diameter of the neck portion. In one such embodiment, the fastener can be a set screw that extends crosswise to the central axis (e.g., in a radial direction) through part of the locking nut and towards the region of reduced diameter on the neck portion. The fastener or pin extends radially towards the region of reduced diameter or substantially tangentially to the region of reduced diameter on the neck portion to provide a structure that blocks axial separation of the locking nut and the accessory mount. Optionally, the fastener or pin engages the region of reduced diameter.

Example 17 includes the subject matter of Example 16, wherein the pin or fastener extends crosswise to the longitudinal axis.

Example 18 includes the subject matter of Example 16, wherein the pin or fastener extends radially towards the neck portion.

Example 19 includes the subject matter of any of Examples 1-18, wherein the central proximal opening and the central distal opening of the locking nut are each sized to receive the muzzle adapter therethrough.

Example 20 includes the subject matter of any of Examples 1-19, wherein the muzzle accessory is a suppressor.

Example 21 includes the subject matter of Example 20, wherein the suppressor includes the accessory mount.

Example 22 includes the subject matter of Example 21, wherein the accessory mount is integral to the suppressor.

Example 23 includes the subject matter of any of Examples 1-20, further comprising the muzzle adapter.

Example 24 includes the subject matter of any of Examples 1-23, wherein the muzzle adapter includes a flash hiding portion extending distally of the adapter body.

Example 25 includes the subject matter of Example 24, wherein the flash hiding portion has an outer diameter less than an inner diameter of the central proximal opening and less than an inner diameter of the central distal opening of the locking nut.

Example 26 includes the subject matter of any of Examples 24-25, wherein the flash hiding portion includes three prongs.

Example 27 includes the subject matter of any of Examples 1-26, wherein the locking nut further comprises a flange extending radially outward, the flange located adjacent the distal end.

Example 28 includes the subject matter of Example 27, wherein the flange has a hexagonal shape.

Example 29 is a method of attaching a suppressor to a firearm barrel, the method comprising providing a muzzle adapter configured for attachment to a firearm barrel, the muzzle adapter having an adapter body with male threads and a bearing surface located proximally of the male threads; providing a suppressor with a suppressor mount connected to a suppressor body, the suppressor mount including an outside surface with male threads and an inside surface with female threads corresponding to the male threads of the muzzle adapter; providing a mounting assembly comprising (i) a locking nut having an inside surface with female threads and an inside taper located proximally of the female threads, and (ii) a locking ring inside the locking nut, the locking ring having an outside face with an outside taper engaging the inside taper in the locking nut and having an inside face configured to engage the bearing surface of the muzzle adapter; inserting the muzzle adapter through the locking nut and locking ring and into the suppressor mount; threading the suppressor onto the muzzle adapter with the female threads of the suppressor mount engaging the male threads of the muzzle adapter; threading the locking nut onto the suppressor mount; and tightening the locking nut so that the locking ring is bound between the locking nut and the muzzle adapter by engagement of the inside face of the locking ring with the bearing surface of the muzzle adapter and by engagement of the outside taper of the locking ring with the inside taper of the locking nut.

Example 30 includes the subject matter of Example 29, wherein the suppressor mount includes an inner sealing taper adjacent the female threads and the muzzle adapter includes a corresponding outer sealing taper, and wherein the threading the suppressor onto the muzzle adapter includes engaging the inner sealing taper of the suppressor mount with the outer sealing taper of the muzzle adapter.

Example 31 includes the subject matter of any of Examples 29-30, wherein threading the suppressor mount onto the muzzle adapter and threading the locking nut onto the suppressor mount are performed in the same rotational direction.

Example 32 includes the subject matter of any of Examples 29-31, wherein threading the locking nut onto the suppressor mount includes maintaining a rotational position of the suppressor with respect to the firearm barrel while threading the locking nut onto the suppressor mount.

Example 33 includes the subject matter of any of Examples 29-32, further comprising installing the muzzle adapter on a muzzle end of a firearm barrel.

Example 34 includes the subject matter of any of Examples 29-33 further comprising installing a retaining structure between the locking nut and the suppressor mount, thereby coupling the locking nut to the suppressor mount.

Example 35 includes the subject matter of any of Examples 29-34, wherein the suppressor includes a neck portion of reduced diameter between the male threads and the suppressor body, and wherein a distal end portion of the locking nut defines an inner circumferential groove, the method further comprising providing a split retaining ring; installing the split retaining ring on the neck portion of the suppressor; and threading the locking nut onto the suppressor mount until the split retaining ring seats in the circumferential groove, thereby coupling the locking nut to the suppressor mount with a radially outer portion of the split retaining ring seated in the circumferential groove and a radially inner portion of the retaining ring occupying the neck portion.

Embodiments of mounting assembly 100 in accordance with the present disclosure provide secure attachment of a muzzle accessory 200 to a firearm barrel 10. For example, the locking nut 160 and locking ring 170 of the mounting assembly 100 provide a secondary retention structure that functions with the threaded engagement of the suppressor and muzzle attachment to securely retain the accessory 200 on the muzzle attachment.

Components of mounting assembly 100 may be constructed from any suitable material(s), as will be apparent in light of this disclosure. For example, some embodiments of mounting assembly 100 are constructed from steel, aluminum, titanium, austenitic nickel-chromium-based alloys sold as Inconel® by Inco Alloys, reinforced polymer composites, or other materials. In some embodiments, mounting assembly 100 can be constructed to withstand high temperatures associated with prolonged rapid fire, such as temperatures exceeding 700° F. More generally, components of the present disclosure can be constructed from any suitable material, including, for example, materials and finishes compliant with United States Defense Standard MIL-W-13855D (Weapons: Small Arms and Aircraft Armament Subsystems, General Specifications For).

Mounting assembly 100 in accordance with present disclosure can be used with a variety of rifles, machine guns, submachine guns, pistols, and other firearms. For example, mounting assembly 100 can be constructed with tolerances, materials, and other configurations suitable for use with machine guns, combat rifles, sniper rifles, hunting rifles, competition shooting rifles, short-barreled rifles, carbines, submachine guns, pistols, and other firearms.

The foregoing description of example embodiments has been presented for the purposes of illustration and description. It is not intended to be exhaustive or to limit the present disclosure to the precise forms disclosed. Many modifications and variations are possible in light of this disclosure. It is intended that the scope of the present disclosure be limited not by this detailed description, but rather by the claims appended hereto. Future-filed applications claiming priority to this application may claim the disclosed subject matter in a different manner and generally may include any set of one or more limitations as variously disclosed or otherwise demonstrated herein.

What is claimed is:

1. A mounting assembly for a muzzle accessory and a muzzle adapter, the muzzle adapter having an adapter body with male threads and an axially extending bearing surface located proximally of the male threads, and the muzzle accessory having an accessory mount with an outside surface defining male threads and an inside surface defining female threads corresponding to the male threads on the muzzle adapter, the mounting assembly comprising:

a locking nut extending along a central axis from a proximal end to a distal end, the proximal end defining a central proximal opening and the distal end defining a central distal opening, the locking nut having an inside surface with female threads and an inside taper located proximally of the female threads of the locking nut, the female threads of the locking nut corresponding to the male threads on the outside surface of the accessory mount, wherein the inside taper extends circumferentially along an inside of the locking nut and reduces in radius moving axially rearward towards the proximal end of the locking nut; and a locking ring having a radially inner face extending axially and configured to engage the axially extending bearing surface on the muzzle adapter and having a radially outer face that includes an outside taper defined by an axially sloping change in radial thickness between the radially inner face and the radially outer face, the outside taper configured to engage the inside taper of the locking nut;

wherein in an assembled state in which the accessory mount threadably engages the muzzle adapter, the locking nut is configured to be threaded onto the accessory mount with the radially inner face of the locking ring engaging the axially extending bearing surface on the muzzle adapter and the outside taper of the locking ring engaging the inside taper of the locking nut.

2. The mounting assembly of claim 1, wherein the locking ring has an annular shape with a break in continuity along a circumference of the locking ring.

3. The mounting assembly of claim 1, wherein:

an outside surface of the muzzle adapter includes an adapter outer sealing taper positioned distally of the male threads of the muzzle adapter;

the inside surface of the accessory mount includes a mount inner sealing taper corresponding to the adapter outer sealing taper and is positioned distally of the female threads on the inside surface of the accessory mount; and in the assembled state, the adapter outer sealing taper sealingly engages the mount inner sealing taper.

4. The mounting assembly of claim 1, wherein the inside taper defines an included first taper angle with respect to the central axis and the outside taper defines an included second taper angle with respect to the central axis, the included first taper angle substantially equal to the included second taper angle.

5. The mounting assembly of claim 4, wherein each of the included first taper angle and the included second taper angle is from 15 to 30 degrees.

6. The mounting assembly of claim 1, wherein the inside face of the locking ring is substantially parallel to the bearing surface on the muzzle adapter.

7. The mounting assembly of claim 1, wherein the female threads on the inside surface of the accessory mount and the male threads on the muzzle adapter are right-hand threads, and wherein the female threads on the inside surface of the locking nut and the male threads on the outside surface of the accessory mount are left-hand threads.

8. The mounting assembly of claim 1, wherein the female threads on the inside surface of the accessory mount and the male threads on the muzzle adapter are left-hand threads, and wherein the female threads on the inside surface of the locking nut and the male threads on the outside surface of the accessory mount are right-hand threads.

9. The mounting assembly of claim 1, further comprising a retaining ring between the locking nut and the accessory mount;

wherein the accessory mount includes a neck portion positioned distally of the male threads on the accessory mount, the neck portion having a reduced diameter compared to the male threads on the accessory mount;

wherein the inside surface of the locking nut defines a circumferential groove adjacent the distal end; and wherein a radially outer part of the retaining ring is in the circumferential groove and a radially inner part of the retaining ring is in the neck portion.

10. The mounting assembly of claim 1, wherein the accessory mount includes a neck portion of reduced diameter positioned distally of the male threads of the accessory mount, and wherein the mounting assembly comprises a pin or fastener between the locking nut and the accessory mount, the pin or fastener extending radially towards the neck portion and having an end received in the neck portion.

11. The mounting assembly of claim 1, wherein the central proximal opening and the central distal opening of the locking nut are each adapted to receive the muzzle adapter therethrough.

12. The mounting assembly of claim 1, wherein the muzzle accessory is a suppressor including the accessory mount.

13. The mounting assembly of claim 1, further comprising the muzzle adapter.

14. The mounting assembly of claim 13, wherein the muzzle adapter includes a flash hiding portion extending distally of the adapter body.

15. The mounting assembly of claim 14, wherein the flash hiding portion includes a plurality of prongs.

16. A method of attaching a suppressor to a firearm barrel, the method comprising:

providing a muzzle adapter configured for attachment to the firearm barrel, the muzzle adapter having an adapter body with male threads and an axially extending bearing surface located proximally of the male threads;

providing the suppressor with a suppressor mount connected to a suppressor body, the suppressor mount including an outside surface with male threads and an inside surface with female threads corresponding to the male threads of the muzzle adapter;

providing a mounting assembly comprising:

a locking nut having an inside surface with female threads and an inside taper located proximally of the female threads of the locking nut, wherein the inside taper is a circumferential surface on the inside of the locking nut that reduces in radius moving axially in a rearward direction; and a locking ring inside the locking nut, the locking ring having a radially outer face with an outside taper defined by an axially sloping change in radial thickness between a radially inner face and the radially outer face of the locking ring, the outside taper configured to engage the inside taper in the locking nut and the radially inner face extending axially and configured to engage the axially extending bearing surface of the muzzle adapter;

inserting the muzzle adapter through the locking nut and locking ring and into the suppressor mount;

threading the suppressor onto the muzzle adapter with the female threads of the suppressor mount engaging the male threads of the muzzle adapter;

threading the locking nut onto the suppressor mount; and tightening the locking nut so that the locking ring is bound between the locking nut and the muzzle adapter by engagement of the inside face of the locking ring with the bearing surface of the muzzle adapter and by engagement of the outside taper of the locking ring with the inside taper of the locking nut.

17. The method of claim 16, wherein the suppressor mount includes an inner sealing taper adjacent the female threads of the suppressor mount and the muzzle adapter includes a corresponding outer sealing taper, and wherein threading the suppressor onto the muzzle adapter includes engaging the inner sealing taper of the suppressor mount with the outer sealing taper of the muzzle adapter.

18. The method of claim 16, wherein threading the suppressor mount onto the muzzle adapter and threading the locking nut onto the suppressor mount are performed in the same rotational direction.

19. The method of claim 16, further comprising installing a retaining structure between the locking nut and the suppressor mount, thereby coupling the locking nut to the suppressor mount.

20. The method of claim 16, wherein the suppressor includes a neck portion of reduced diameter between the male threads of the suppressor mount and the suppressor body, and wherein a distal end portion of the locking nut defines an inner circumferential groove, the method further comprising:

providing a snap ring;

installing the snap ring on the neck portion of the suppressor; and threading the locking nut onto the suppressor mount until the snap ring seats in the circumferential groove, thereby coupling the locking nut to the suppressor mount with a radially outer portion of the snap ring seated in the circumferential groove and a radially inner portion of the snap ring occupying the neck portion.

* * * * *